US007500420B2

(12) United States Patent
Cvjetkovic et al.

(10) Patent No.: US 7,500,420 B2
(45) Date of Patent: Mar. 10, 2009

(54) PAPER TOWEL DISPENSER APPARATUS

(75) Inventors: Niko Anthony Cvjetkovic, La Palma, CA (US); Joel P. Keily, Corona, CA (US); Patrick C. Perrin, Rancho Palos Verdes, CA (US)

(73) Assignee: Perrin Manufacturing Company, City of Industry, CA (US)

( * ) Notice: Subject to any disclaimer, the term of this patent is extended or adjusted under 35 U.S.C. 154(b) by 475 days.

(21) Appl. No.: 11/114,860

(22) Filed: Apr. 25, 2005

(65) Prior Publication Data

US 2006/0236832 A1 Oct. 26, 2006

(51) Int. Cl.
*B26D 1/62* (2006.01)
*B26F 3/02* (2006.01)
*B26H 16/10* (2006.01)

(52) U.S. Cl. ..... 83/649; 83/322; 83/327; 83/334; 225/2; 225/96; 225/106

(58) Field of Classification Search ..... 83/649, 83/337, 327, 322, 422, 734, 443, 446, 450, 83/659, 334; 225/2, 96, 106, 16, 22, 34, 225/51, 67, 86, 69, 85, 90; 242/559, 559.1
See application file for complete search history.

(56) References Cited

U.S. PATENT DOCUMENTS 1,543,299 A 6/1925 Shelley
2,051,242 A 8/1936 Birr
2,560,061 A 7/1951 Agamaite, Jr.
3,575,328 A 4/1971 Jespersen et al.
3,739,965 A 6/1973 Jespersen et al.
3,896,691 A 7/1975 Granger et al.
RE28,911 E 7/1976 Jespersen et al.
3,998,120 A 12/1976 Granger et al.
4,122,738 A 10/1978 Granger
4,186,633 A 2/1980 Baumann et al.
4,188,844 A 2/1980 DeLuca
4,213,363 A 7/1980 Granger
4,276,797 A 7/1981 Baumann et al.
4,307,639 A 12/1981 DeLuca
4,404,880 A * 9/1983 DeLuca ..... 83/42
4,432,261 A 2/1984 DeLuca
4,441,392 A 4/1984 DeLuca
4,621,755 A 11/1986 Granger
4,635,837 A 1/1987 Granger
4,712,461 A * 12/1987 Rasmussen ..... 83/334
4,807,824 A 2/1989 Gains et al.
4,844,361 A 7/1989 Granger
4,846,035 A 7/1989 Granger
5,013,291 A 5/1991 Granger
5,048,386 A * 9/1991 DeLuca et al. ..... 83/37
5,078,033 A 1/1992 Formon
5,108,357 A 4/1992 Granger
5,135,147 A 8/1992 Granger
5,146,830 A 9/1992 Granger (Continued)

*Primary Examiner*—Ghassem Alie
(74) *Attorney, Agent, or Firm*—Thomas R. Lampe

(57) ABSTRACT

Dispenser apparatus for dispensing paper toweling includes structure for damping forces applied to a roll of paper toweling when overspin slack is taken up and modifying cutter blade timing to reduce peak pull force during dispensing. A biased damping roller is displaceable by toweling when the toweling is pulled to take up the slack and maintain the toweling in taut condition.

14 Claims, 6 Drawing Sheets

U.S. PATENT DOCUMENTS 6,237,871 B1 * 5/2001 Morand et al. ..... 242/564.2
6,314,850 B1 11/2001 Morand
6,553,879 B2 4/2003 Morand
2002/0096028 A1 * 7/2002 Morand ..... 83/13

* cited by examiner

PAPER TOWEL DISPENSER APPARATUS

TECHNICAL FIELD

This invention relates to dispenser apparatus for dispensing paper toweling from a roll of paper toweling.

BACKGROUND OF THE INVENTION

Many dispenser systems are known in the prior art for dispensing paper toweling from rolls thereof. In some cases the paper toweling is comprised of individual paper towel segments separated by perforated tear lines, and in others the toweling has no perforated tear lines formed therein, the user severing or cutting individual sheets from the toweling by some suitable means incorporated in the dispenser.

The dispenser system disclosed and claimed herein is of the latter type.

U.S. Pat. No. 6,553,879, issued Apr. 29, 2003, discloses apparatus for dispensing paper toweling including a rotatable toweling support roller and a cutter blade pivotally mounted on the outer peripheral portion of the roller. The blade is movable between a first position in which the cutting edge of the blade is positioned closely adjacent to the outer peripheral portion and a second position in which the blade is disposed at an angle relative to the outer peripheral portion with the cutting edge of the blade spaced from the toweling support roller. The cutter blade when in the second position projects in a direction generally opposed to the direction of rotation of the toweling support roller so that pulling force exerted on the toweling by a user will bear against the cutting edge of the cutter blade to sever the toweling.

The arrangement of U.S. Pat. No. 6,553,879 also incorporates a member which is rotatably mounted on the housing of the apparatus extending between the side walls thereof. The member does not rotate until a roll of toweling expires. At that time the member rotates to position the lead end of a reserve roll of toweling on the toweling support roller. Springs continuously bias the member 74 toward the toweling support roller and the member 74 performs the auxiliary functions of maintaining the toweling between the member and the discharge end of the dispenser under some degree of tension when the paper toweling is pulled during dispensing and maintaining the toweling positioned on the toweling support roller.

The arrangement of U.S. Pat. No. 6,314,850 has met with considerable commercial success; however, some problems with "tabbing" have occurred during use of the dispenser. Tabbing occurs when a piece of towel tears off the sheet when a user grasps and pulls the paper. Tabbing may occur with one or two hand pulls. Papers that absorb water at the greatest rate are most likely to tab. The rate of water absorbency varies by paper manufacturer and grade. Premium grade papers tend to absorb water the quickest and are generally harder to cut which leads to a higher rate of tabbing.

It has been found that tabbing occurs when overspin slack is taken up and/or when the blade tries to cut the paper. A "shock" is present at the moment the overspin slack is exhausted. The shock occurs because the stationary roll towel must begin rotating at the moment that the overspin slack is exhausted. The shock is greatest with full rolls and diminishes as the roll is exhausted.

The present invention is directed to structure which addresses and greatly reduces the tabbing problem. The structure disclosed and claimed herein is not taught or suggested by U.S. Pat. No. 6,553,879 or the following known patents which employ cutter blades associated with a paper towel support roller to cut paper toweling supported thereby: U.S. Pat. No. 1,543,299, issued June, 1925, U.S. Pat. No. 2,051,242, issued August, 1936, U.S. Pat. No. 2,560,061, issued July, 1951, U.S. Pat. No. 3,575,328, issued April, 1971, U.S. Pat. No. 3,739,965, issued June, 1973, U.S. Pat. No. 3,896,691, issued July, 1975, U.S. Pat. No. RE28,911, issued July, 1976, U.S. Pat. No. 3,998,120, issued December, 1976, U.S. Pat. No. 4,122,738, issued October, 1978, U.S. Pat. No. 4,186,633, issued February, 1980, U.S. Pat. No. 4,188,844, issued February, 1980, U.S. Pat. No. 4,213,363, issued July, 1980, U.S. Pat. No. 4,276,797, issued July, 1981, U.S. Pat. No. 4,307,639, issued December, 1981, U.S. Pat. No. 4,404,880, issued September 1983, U.S. Pat. No. 4,432,261, issued February, 1984, U.S. Pat. No. 4,441,392, issued April, 1984, U.S. Pat. No. 4,621,755, issued November, 1986, U.S. Pat. No. 4,635,837, issued January, 1987, U.S. Pat. No. 4,712,461, issued December, 1987, U.S. Pat. No. 4,807,824, issued February, 1989, U.S. Pat. No. 4,844,361, issued July, 1989, U.S. Pat. No. 4,846,035, issued July, 1989, U.S. Pat. No. 5,013,291, issued May, 1991, U.S. Pat. No. 5,048,386, issued September, 1991, U.S. Pat. No. 5,078,033, issued January, 1992, U.S. Pat. No. 5,108,357, issued April, 1992, U.S. Pat. No. 5,135,147, issued August, 1992 and U.S. Pat. No. 5,146,830, issued September, 1992.

DISCLOSURE OF INVENTION

In general, the present invention addresses the tabbing problem by incorporating a damping system to absorb the shock that occurs when the roll overspin slack is taken up and by incorporating modifications which result in reduced peak pull force.

The paper towel dispenser apparatus of the present invention is for dispensing paper toweling from a roll of paper toweling responsive to a pulling force being applied to the toweling.

The apparatus includes a housing and a roll support operatively associated with the housing for rotatably supporting the roll of paper toweling.

A rotatable toweling support roller is within the housing spaced from the roll support for receiving toweling from the roll of paper toweling and supporting the toweling. The toweling support roller has a cylindrically-shaped outer peripheral portion having an external surface and being rotatable in a predetermined direction of rotation when a manual pulling force is applied to toweling supported thereby.

A cutter blade is located at the cylindrically-shaped outer peripheral portion and having a cutting edge. The cutter blade is pivotally movable between a first condition wherein the cutter blade does not project outwardly from the external surface of the cylindrically-shaped outer peripheral portion and a second condition wherein the cutter blade projects outwardly from the external surface of the cylindrically-shaped outer peripheral portion with the cutting edge thereof spaced from the external surface of the cylindrically-shaped outer peripheral portion.

Blade actuator means is provided for pivoting the cutter blade between the first and second conditions responsive to rotation of the toweling support roller due to the manual pulling force being applied to the toweling at a location externally of the housing and tensioning of the toweling.

The cutting edge of the cutter blade when the cutter blade is in the second condition engages toweling on the toweling support roller during rotation of the toweling support roller to sever the toweling to create a towel sheet severed from the remainder of the paper toweling due to the manual pulling force and tensioning of the toweling between the cutting edge of the cutter blade and the location on the toweling where the pulling force is applied. The toweling support roller is rotatable after severing of the toweling to position a lead end of the remainder of the toweling for subsequent manual pulling and return the cutter blade to its first condition.

Damping structure is incorporated in the combination and includes at least one damping element engaging the remainder of the toweling between the roll of paper toweling and the toweling support roller to dampen forces applied to the roll of paper toweling resulting from taking up of toweling slack between the roll of paper toweling and the toweling support roller caused by manual pulling of the remainder of the toweling at a location externally of the housing and overspin of the roll of paper toweling caused thereby.

The cutter blade during rotation of the toweling support roller is movable between the first condition through the second condition to a third condition wherein the cutter blade is disposed generally orthogonal to the external surface. The rotatable damping roller forming the nip with the toweling support roller at a predetermined location enables the toweling support roller to rotate at least about 180 degrees from passage of the cutter blade under the rotatable damping roller with the cutter blade in the first condition to a subsequent location wherein the cutter blade is in the third condition.

Other features, advantages and objects of the present invention will become apparent with reference to the following description and accompanying drawings.

MODES FOR CARRYING OUT THE INVENTION

Figure 1:
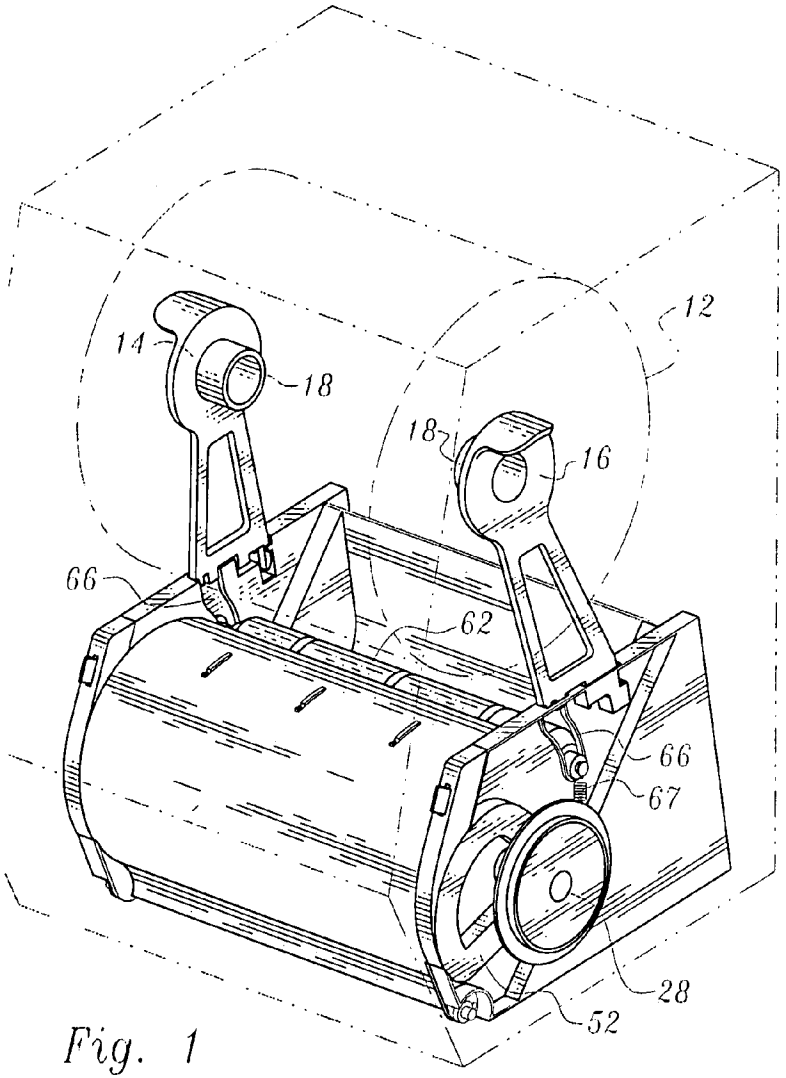
FIG. 1 is a frontal, perspective view illustrating structural components of a preferred first embodiment of the invention in solid lines, a cabinet and roll of paper toweling illustrated in phantom.
Figure 2:
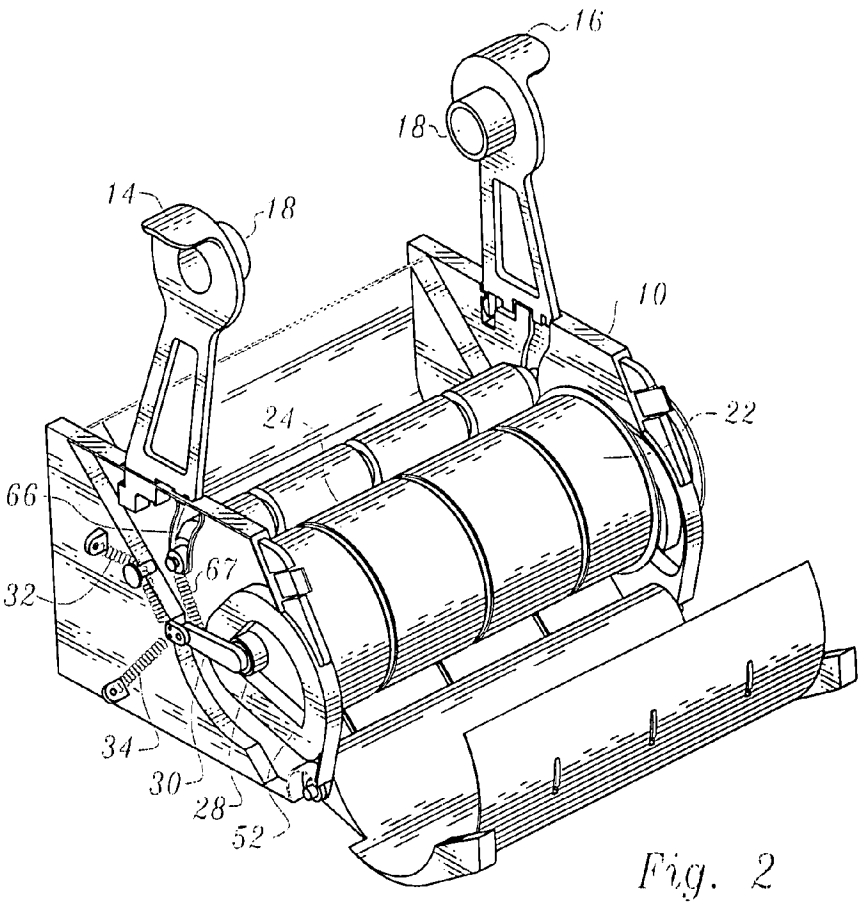
FIG. 2 is a perspective view of the structural components illustrated in FIG. 1 in solid lines with a cover or guide plate swung away to an open position to disclose certain operational details thereof.

Referring now to FIGS. 1-7 and 13, dispenser apparatus constructed in accordance with the teachings of the present invention is illustrated. The invention includes a housing 10 which is suitably positioned in a cabinet such as that shown in phantom in FIG. 1. A roll support is operatively associated with the housing to rotatably support a roll of paper toweling 12. More particularly, the roll support includes two double-ended arms 14, 16 spaced from one another and roll engagement members 18 at the distal or upper ends of the arms for entering the ends of the roll 12. Roll 12 is rotatably supported by the roll engagement members.

A rotatable toweling support roller 22 is within the housing and spaced from the roll support and roll engagement members. The toweling support roller is for receiving toweling from the roll of paper toweling 12 and supporting the toweling. The toweling support roller 22 has a cylindrically-shaped outer peripheral portion having an external surface 24. The toweling support roller is rotatable in a predetermined direction when a manual pulling force is applied to toweling supported thereby. Stub shafts 28 project from the opposed ends of the toweling support roller through openings formed in the housing to support the rotatable toweling support roller. A lever arm 30 is connected to the distal end of one of the stub shafts. Springs 32, 34 extend between the housing and the lever arm 30 which control operation and positioning of the toweling support roller 22 in the manner taught by above referenced U.S. Pat. No. 6,314,850. Such operation will be described in more detail below.

As is the case with the paper towel dispenser apparatus disclosed in U.S. Pat. No. 6,314,850, the present apparatus also incorporates a cutter blade, designated by reference numeral 40, which is located at the cylindrically-shaped outer peripheral portion of the toweling support roller, the cutter blade 40 having a cutting edge 42. Cutter blade 40 is pivotally connected to the toweling support roller about a pivot located at the cylindrically-shaped outer peripheral portion thereof. Cutter blade 40 has attached to the ends thereof cam followers 44, each including a cam follower arm 46 and a roller 48. Each roller 48 rides in a channel 50 of the cam 52. A cam 52 is located at each end of the housing, it being understood that the channels 50 of the cams are directed inwardly.

Rotation of toweling support roller 22 will cause the cam followers to move along the cam surfaces defining channels 50. This, in turn, will cause the cutter blade to pivot relative to the toweling support roller, again as taught in U.S. Pat. No. 6,314,850.

The cutter blade upon rotation of the toweling support roller moves between a first condition wherein the blade cutting edge is positioned closely adjacent to the cylindrically-shaped outer peripheral portion and the cutter blade does not project substantially outwardly from the external surface of the cylindrically-shaped outer peripheral portion, a second condition wherein the cutter blade is disposed at an angle relative to the cylindrically-shaped outer peripheral portion with the cutting edge thereof spaced from the toweling support roller and the blade projecting from the pivot in a direction generally opposed to the direction of rotation of the toweling support roller and a third condition wherein the cutter blade is disposed generally orthogonal to the external surface.

Figure 3:
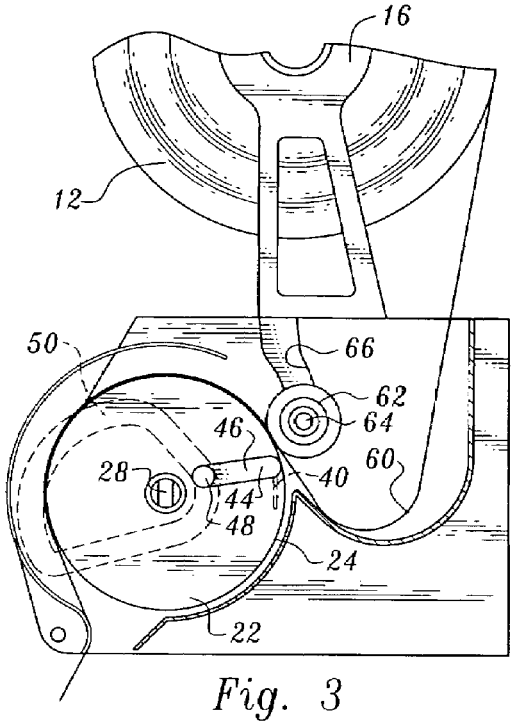
FIG. 3 is a side, elevational view in partial cross-section illustrating paper toweling in slack condition between a roll of paper toweling and a rotatable toweling support roller, a damping roller of damping structure incorporated in the invention forming a nip with the toweling support roller.
Figure 4:
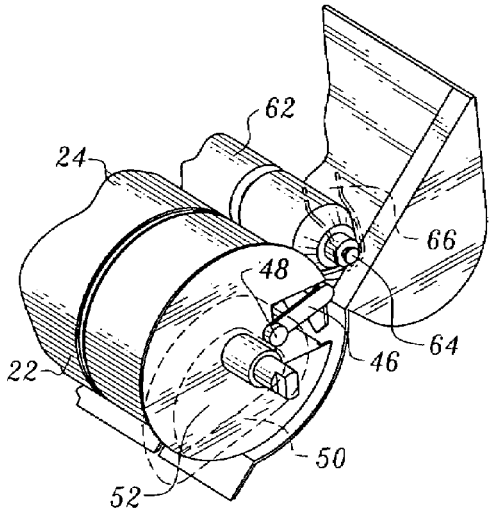
FIG. 4 is a perspective view illustrating selected portions of the structure with the components in the same relative positions as shown in FIG. 3.

FIG. 3 discloses the cutter blade 40 in its first condition. Counter clockwise rotation of the toweling support roller 22 to the position shown in FIG. 5 causes partial pivotal movement of the cutter blade to the second condition wherein the cutter blade projects outwardly from the external surface and is disposed at an acute angle with respect thereto, projecting outwardly in a direction generally opposed to the direction of rotation of the toweling support roller.

Figure 5:
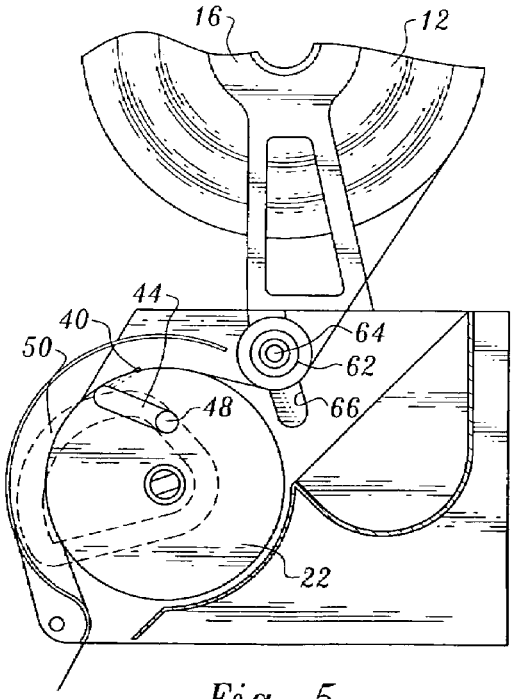
FIG. 5 is a view similar to FIG. 3, but illustrating the paper toweling between the toweling support roller and the roll of toweling pulled taut to remove the slack, the damping roller illustrated as being displaced to dampen pulling forces applied to the roll of paper toweling.
Figure 6:
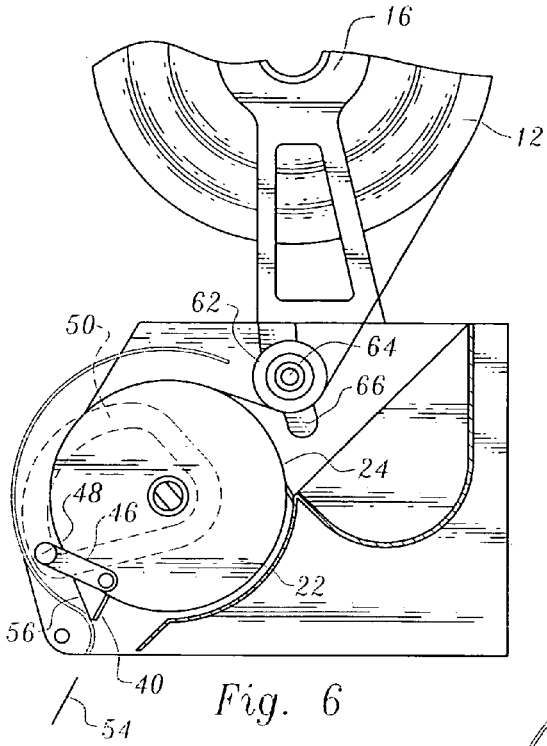
FIGS. 6 and 7 are views similar to FIGS. 3 and 5, but illustrating the structural components in subsequent sequential relative positions.
Figure 7:
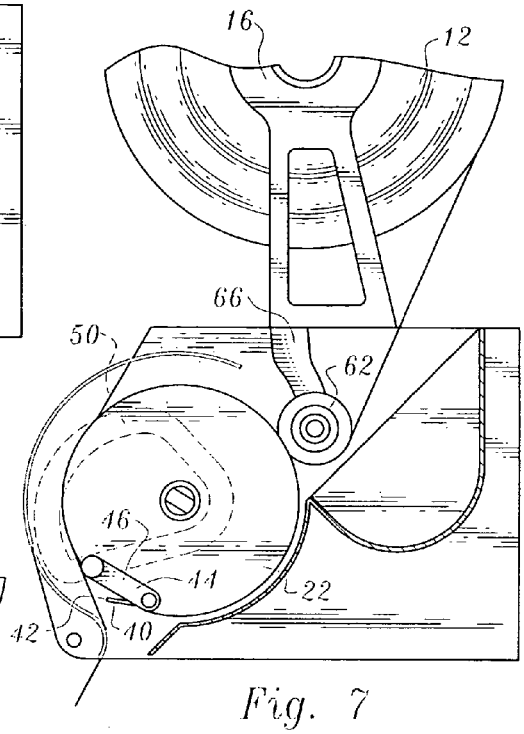
Figure 13:
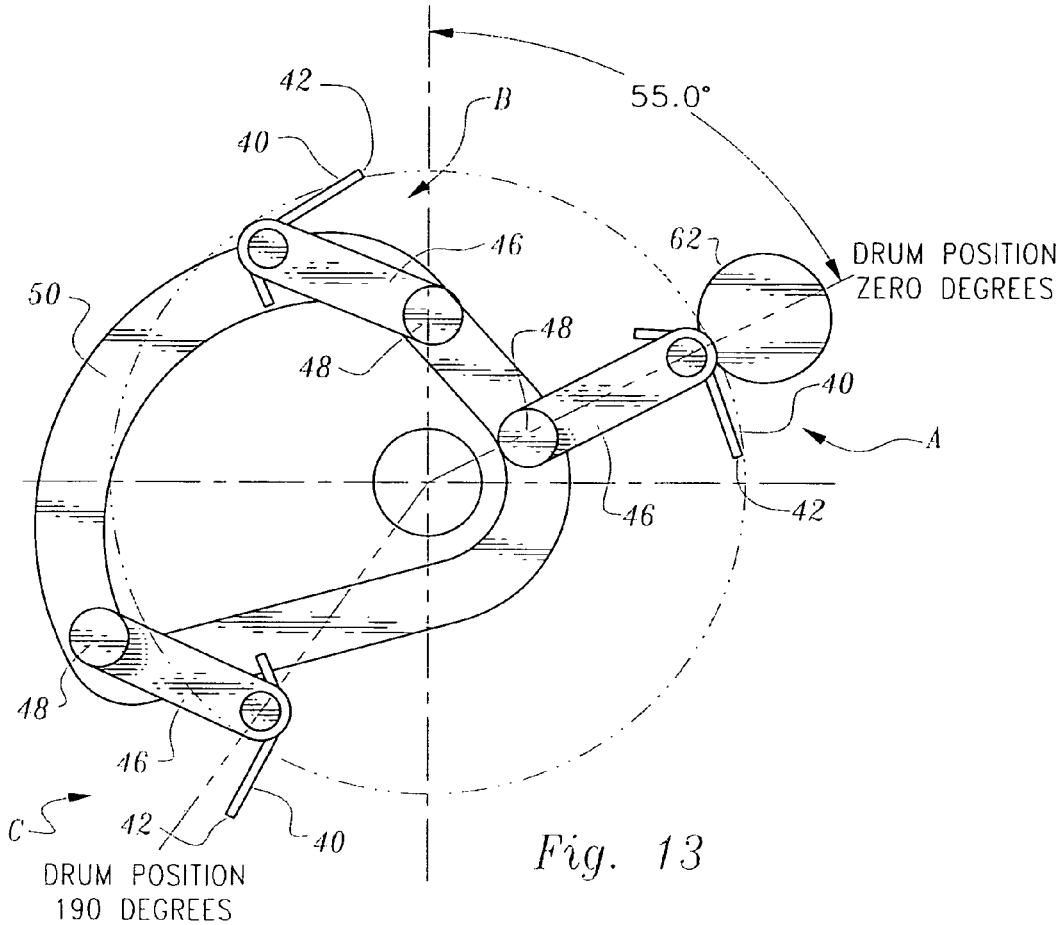
FIG. 13 is a schematic illustration relating to the first embodiment illustrating relative positioning of the rotatable toweling support roller, the damping roller and the cutter blade, the latter being shown in a plurality of conditions resulting from rotation of the toweling support roller.

FIG. 5 shows the blade in a stage of its placement at an acute angle whereby a user pulling the free end of the toweling extending from the housing causes engagement between the toweling and the cutter blade to sever same during rotation of the toweling support roller. FIG. 6 shows the cutter blade pivoted to a third condition wherein the cutter blade is disposed generally orthogonal to the external surface of the toweling support roller. FIG. 7 shows the blade in the process of being returned to its first condition upon further continued movement of the roller. FIG. 13 illustrates schematically the positioning of the cutter blade in its first condition A, its second condition B, and its third condition C.

In general, the operation of the cutter blade and roller is as disclosed in U.S. Pat. No. 6,314,850. That is to say, action of the cutter blade during rotation of the toweling support roller will sever the toweling to create a toweling sheet severed from the remainder of the paper toweling due to the manual pulling force and tensioning of the toweling between the cutting edge of the cutter blade and the location on the toweling where the pulling force is applied. The toweling support roller continues rotation under influence of the associated springs 32, 34 after severing of the toweling to position a lead end of the remainder of the toweling for subsequent manual access and pulling. FIG. 6 shows the trailing end of a severed towel sheet 54 and the resulting lead end 56 of the remainder of the toweling. FIG. 7 shows the new lead end exiting the bottom opening of the housing which is partially defined by the curved lower end of a closed front cover of the dispenser apparatus upon further rotation of the toweling support roller.

The paper towel dispenser apparatus differs from the paper towel dispenser of U.S. Pat. No. 6,314,850 in a number of respects, one of which is the incorporation with the structure just defined of damping structure including a damping element engaging the remainder of a toweling between the roll of paper toweling 12 and the toweling support roller 22 to dampen forces applied to the roll of paper toweling resulting from taking up of toweling slack between the roll of paper toweling and the toweling support roller caused by manual pulling of the remainder of the toweling at a location externally of the housing and resultant overspin of the roll of paper toweling caused thereby.

FIG. 3 shows a slack portion 60 which exists due to prior dispensing of a severed towel sheet. It has been found that tabbing occurs when overspin slack such as that shown in FIG. 3 is taken up and/or when the blade tries to cut the paper. A "shock" is present at the moment the overspin slack is exhausted.

To alleviate such shock and greatly lessen the chance for tabbing, the damping structure of the invention is employed. The damping structure includes a damping element in the form of a rotatable damping roller 62 which is displaceably mounted relative to the housing. In the arrangement illustrated, stub axles 64 project from the ends of the damping roller, the stub axles being positioned in generally upwardly extending, curved slots 66 formed in housing 10. In the arrangement illustrated, tension springs 67 extending between the stub axles and the housing continuously urge the damping roller downwardly and into engagement with the toweling support roller to form a nip therewith. As slack is taken up upon pulling of the lead end of the paper toweling, the toweling between the roll of toweling 12 and the toweling support roller will become taut. This will cause the damping roller to move in a generally upward direction to dampen the forces applied to the roll of paper toweling, as shown in FIG. 5. After severing of the towel sheet and the removal of pulling forces on the remaining toweling, the biased toweling support roller will continue rotation as shown in FIG. 7 and the damping roller will return to its "home" position to again be positioned to dampen any slack that may subsequently occur.

Another aspect of the present invention addressing the tabbing problem which results in the reduction of peak pull force during operation involves modifications relating to blade operation timing. With such modifications the cut is started earlier than in the arrangement shown in U.S. Pat. No. 6,314,850 and the cut occurs over a larger amount of drum rotation. With the arrangement disclosed, the rotatable damping roller 62 forms its nip with the toweling support roller at a predetermined location enabling the toweling support roller to rotate at least about 180 degrees from passage of the cutter blade under the rotatable damping roller with the cutter blade in the first condition to a subsequent location wherein the cutter blade is in its third condition.

Referring to FIG. 13, in the preferred embodiment the toweling support roller rotates 190 degrees from passage of the cutter blade under the rotatable damping roller with the cutter blade in the first condition A to the location wherein the cutter blade is in the third condition C. The nip between the rotatable damping roller and the toweling support roller is located at the rear upper quadrant of the toweling support roller and the axis of rotation of the rotatable damping roller is disposed in a plane passing through the axis of rotation of the toweling support roller forming an angle of 55 degrees with a vertical plane. Of course the channel 50 of the cam 52 has been modified from the arrangement shown in U.S. Pat. No. 6,314,850 to accomplish the desired end result.

Figure 8:
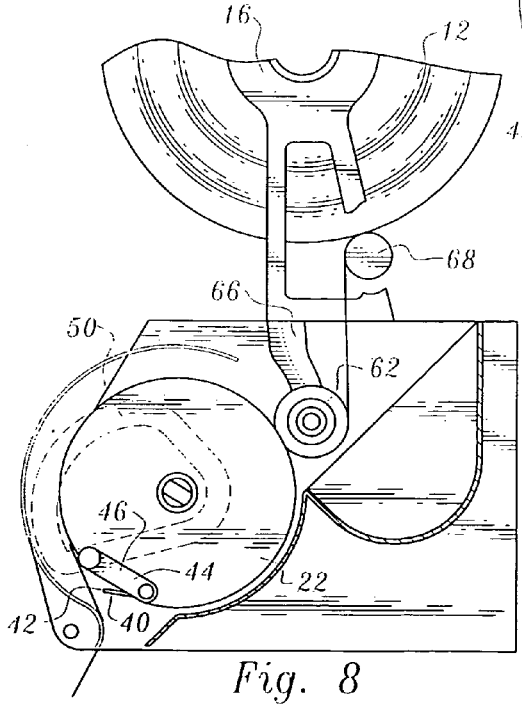
FIG. 8 is a view similar to FIG. 7, but illustrating an alternative embodiment differing slightly from that shown in FIG. 7.

FIG. 8 shows a second embodiment of the invention which conforms in essentially all respects to the first embodiment just discussed except that a roller 68 is positioned between roll of toweling 12 and damping roller 62 to create additional towel wrap around the damping roller, creating a geometrical condition that gives additional damping action.

Figure 9:
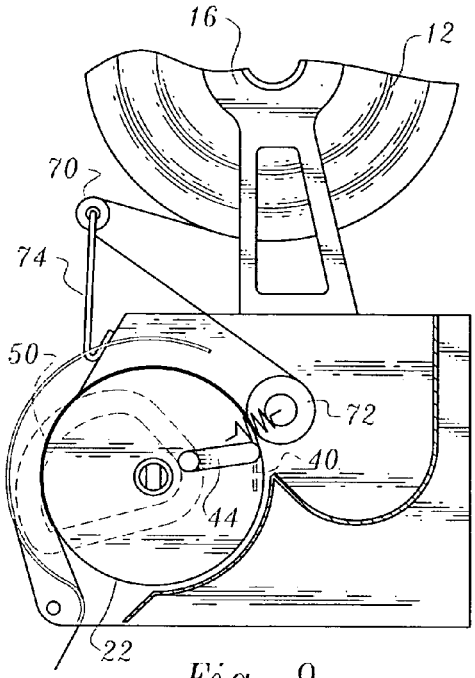
FIGS. 9 and 10 are side, elevational views illustrating components of a third embodiment of the invention in positions assumed thereby during different stages of operation.
Figure 10:
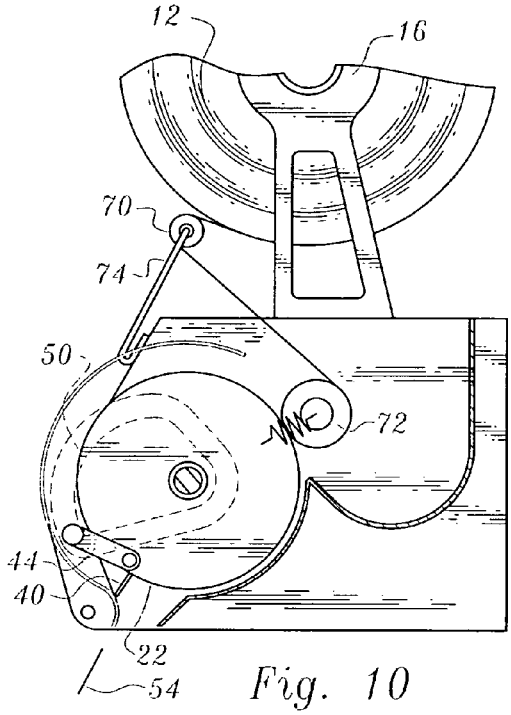

FIGS. 9 and 10 show a third embodiment of the invention, with like structural elements illustrated being numbered as those shown in the FIGS. 1-7 embodiment. In this embodiment, a roller 72 always forms a closed nip with the toweling support roller 22. A damping roller 70 is rotatably supported at the distal end of a spring arm 74, the proximal end of the spring arm 74 being affixed to the housing. Flexing of the spring arm provides the damping action.

Figure 11:
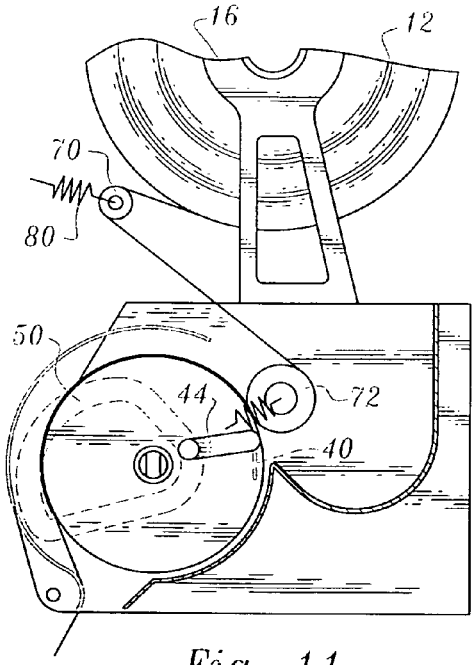
FIGS. 11 and 12 are views similar to FIGS. 9 and 10, but illustrating a fourth embodiment.
Figure 12:
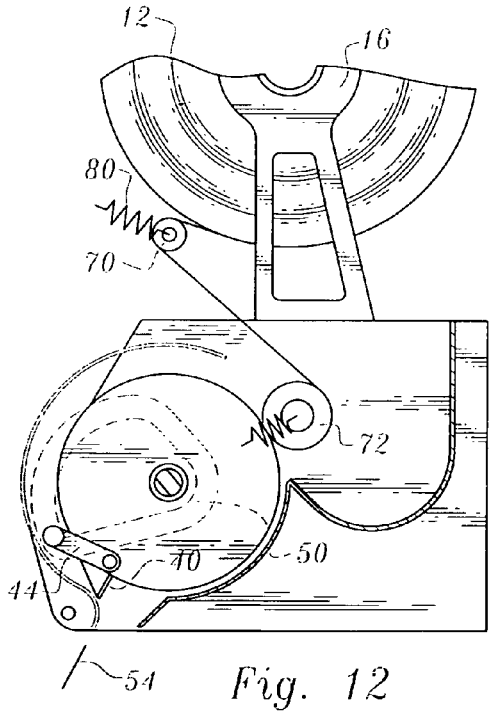

FIGS. 11 and 12 illustrate an embodiment similar to that of FIGS. 9 and 10 except that a coil spring 80, rather than a flexible spring arm, is employed to produce tensional damping forces.

Figure 14:
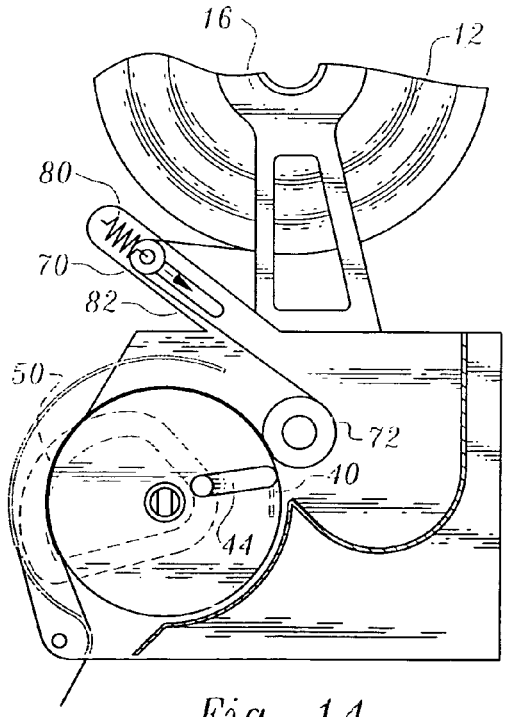
FIG. 14 is a side, elevational view in partial cross-section showing a fifth embodiment of the invention.

The embodiment of FIG. 14 shows an arrangement similar to that of FIGS. 11 and 12, except that damping roller 70 is located in a guide slot 82.

Figure 15:
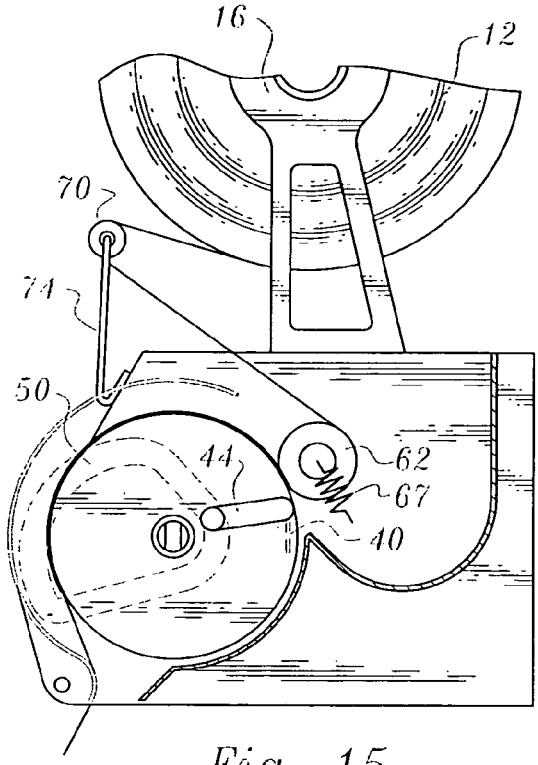
FIGS. 15 and 16 are views similar to FIGS. 3 and 5 illustrating a sixth embodiment of the invention.
Figure 16:
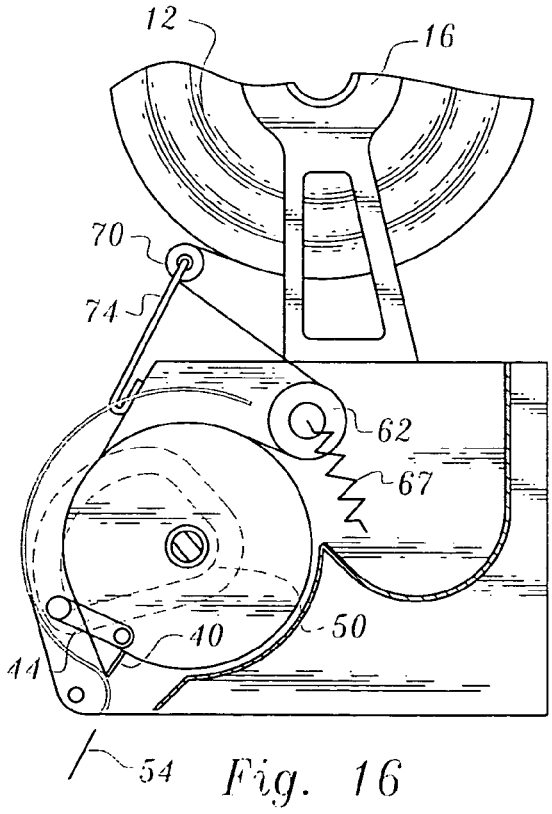

In the embodiment of FIGS. 15 and 16, two damping elements are employed, namely damping rollers 70 and 62, the latter being capable of movement toward or away from toweling support roller 22 as in the embodiment of FIGS. 1-7, the biasing springs associated therewith being sufficiently weak to allow this. Damping roller 70 is mounted on the distal end of a flexible spring arm 74.

The damping rollers 62 and 70 are spaced from one another and engage the toweling between the roll of paper toweling 12 and the toweling support roller 22 at different locations thereon. The damping rollers 62, 70 exert differently directed forces on the toweling to maintain the toweling taut and in a serpentine configuration. When employing a plurality of damping rollers, less movement per roller is required to take up slack.

The invention claimed is:

1. Paper towel dispenser apparatus for dispensing paper toweling from a roll of paper toweling responsive to a pulling force being applied to said toweling, said apparatus comprising, in combination:

a housing;

a roll support operatively associated with said housing for rotatably supporting the roll of paper toweling;

a rotatable toweling support roller within said housing spaced from said roll support for receiving toweling from the roll of paper toweling and supporting the toweling, said toweling support roller having a cylindrically-shaped outer peripheral portion having an external surface and being rotatable in a predetermined direction of rotation when a manual pulling force is applied to toweling supported thereby;

a cutter blade located at the cylindrically-shaped outer peripheral portion and having a cutting edge, said cutter blade being pivotally movable between a first condition wherein said cutter blade does not project substantially outwardly from the external surface of said cylindrically-shaped outer peripheral portion and a second condition wherein said cutter blade projects outwardly from the external surface of said cylindrically-shaped outer peripheral portion with the cutting edge thereof spaced from the external surface of said cylindrically-shaped outer peripheral portion;

blade actuator means for pivoting said cutter blade between said first and second conditions responsive to rotation of said toweling support roller due to the manual pulling force being applied to said toweling at a location externally of said housing and tensioning of said toweling, the cutting edge of the cutter blade when said cutter blade is in said second condition engaging toweling on the toweling support roller during rotation of the toweling support roller to sever the toweling to create a towel sheet severed from the remainder of said paper toweling due to said manual pulling force and tensioning of said toweling between the cutting edge of the cutter blade and the location on said toweling where the pulling force is applied, and said toweling support roller being rotatable after severing of said toweling to position a lead end of the remainder of said toweling for subsequent manual pulling; and a damping structure including at least one damping element engaging a portion of said toweling between said roll of paper toweling and said toweling support roller to dampen forces applied to said roll of paper toweling resulting from taking up of toweling slack between said roll of paper toweling and said toweling support roller caused by manual pulling of the remainder of said toweling at a location externally of said housing, said at least one damping element comprising a rotatable damping roller along the path of movement of said toweling displaceably mounted relative to said housing, said roll of paper toweling and said toweling support roller, said rotatable damping roller engageable with and displaceable by said portion of the toweling extending between said roll of paper toweling and said toweling support roller to move away from said toweling support roller when the remainder of said toweling is manually pulled and the portion of the toweling extending between said roll of paper toweling and said toweling support roller changes from a slack condition to a taut condition, the rotatable damping roller maintaining the portion of the toweling extending between said roll of paper toweling and said toweling support roller in taut condition at least until said toweling is severed by said cutter blade.

2. The paper towel dispenser apparatus according to claim 1 wherein said cutter blade lies substantially flat against the toweling support roller with the cutting edge thereof positioned closely adjacent to the external surface of said cylindrically-shaped outer peripheral portion when in said first condition and wherein said cutter blade when in said second condition projects outwardly from the external surface and is disposed at an acute angle with respect thereto, projecting outwardly in a direction generally opposed to the direction of rotation of said toweling support roller.

3. The paper towel dispenser apparatus according to claim 2 wherein said cutter blade pivots about a pivot located at the external surface.

4. The paper towel dispenser apparatus according to claim 1 wherein said damping structure additionally comprises biasing structure operatively associated with said rotatable damping roller to bias said rotatable damping roller toward the portion of the toweling extending between said roll of paper toweling and said toweling support roller.

5. The paper towel dispenser apparatus according to claim 4 wherein said biasing structure comprises at least one spring operatively connected to said rotatable damping roller.

6. The paper towel dispenser apparatus according to claim 5 wherein said damping structure additionally includes damping roller mounting structure within said housing receiving opposed ends of said rotatable damping roller.

7. The paper towel dispenser apparatus according to claim 6 wherein said damping roller mounting structure defines slots receiving opposed ends of said rotatable damping roller and guiding movement of said opposed ends when the portion of the toweling between the roll of paper toweling and the toweling support roller changes between slack condition and taut condition.

8. The paper towel dispenser apparatus according to claim 5 wherein said at least one spring comprises a spring arm having a proximal end fixed in position relative to said housing and a movable distal end rotatably supporting said rotatable damping roller.

9. The paper towel dispenser apparatus according to claim 1 wherein said damping structure includes a plurality of damping elements, said damping elements being spaced from one another and engaging the remainder of said toweling between said roll of paper toweling and said toweling support roller at different locations thereon.

10. The paper toweling dispenser apparatus according to claim 9 wherein said damping elements comprise biased rollers exerting differently directed forces on the remainder of said toweling between said roll of paper toweling and said toweling support roller to maintain the remainder of said toweling between said roll of paper toweling and said toweling support roller taut and in a serpentine configuration.

11. The paper towel dispenser apparatus according to claim 1 wherein said rotatable damping roller is biased toward said toweling support roller to alternatively form a nip therewith exerting opposed forces on the remainder of said toweling or displaceable by the portion of toweling extending between said roll of paper toweling and said toweling support roller when the remainder of said toweling is manually pulled and the portion of toweling between said roll of paper toweling and said toweling support roller changes from a slack condition to a taut condition.

12. The paper towel dispenser apparatus according to claim 11 wherein said cutter blade during rotation of said toweling support roller is movable between said first condition through said second condition to a third condition wherein said cutter blade is disposed generally orthogonal to said external surface, said rotatable damping roller forming said nip with said toweling support roller at a predetermined location enabling said toweling support roller to rotate at least about 180 degrees from passage of said cutter blade under said rotatable damping roller with said cutter blade in said first condition to a subsequent location wherein said cutter blade is in said third condition.

13. The paper towel dispenser apparatus according to claim 12 wherein said rotatable damping roller forms said nip with said toweling support roller at a predetermined location located at the rear upper quadrant of said toweling support roller enabling said toweling support roller to rotate about 190 degrees from passage of said cutter blade under said rotatable damping roller with said cutter blade in said first condition to a subsequent location wherein said cutter blade is in said third condition.

14. The paper towel dispenser apparatus according to claim 13 wherein the axis of rotation of said rotatable damping roller is disposed in a plane passing through the axis of rotation of said toweling support roller forming an angle of substantially 55 degrees with a vertical plane.

* * * * *